US012405086B2

(12) United States Patent
Krtolica

(10) Patent No.: US 12,405,086 B2
(45) Date of Patent: Sep. 2, 2025

(54) ADJUSTABLE RETICLES FOR SIGHTING OPERATIONS, AND RELATED METHODS, APPARATUS, AND SIGHT DEVICES

(71) Applicant: Styled Brands Inc., Calgary (CA)

(72) Inventor: Vanja Krtolica, Calgary (CA)

(73) Assignee: Styled Brands Inc., Calgary (CA)

( * ) Notice: Subject to any disclaimer, the term of this patent is extended or adjusted under 35 U.S.C. 154(b) by 5 days.

(21) Appl. No.: 18/416,796

(22) Filed: Jan. 18, 2024

(65) Prior Publication Data

US 2025/0237480 A1 Jul. 24, 2025

(51) Int. Cl.
*F41G 1/34* (2006.01)

(52) U.S. Cl.
CPC ..... *F41G 1/345* (2013.01)

(58) Field of Classification Search
CPC ..... F42G 1/345
USPC ..... 42/132
See application file for complete search history.

(56) References Cited

U.S. PATENT DOCUMENTS 3,213,539 A 10/1965 Burris
4,627,171 A * 12/1986 Dudney ..... F41G 1/345 42/123
6,429,970 B2 * 8/2002 Ruh ..... G02B 27/34 359/399
8,353,454 B2 * 1/2013 Sammut ..... F41G 1/00 235/404
9,255,770 B1 * 2/2016 DiCorte ..... F41G 1/35
10,003,756 B2 6/2018 Masarik et al.
10,139,197 B1 * 11/2018 Horton ..... F41G 1/383
10,823,532 B2 11/2020 Gallery et al.
10,935,344 B2 3/2021 Hamilton et al.
11,796,286 B2 10/2023 Campbell
11,867,478 B2 * 1/2024 Smith ..... F41G 11/003
2002/0078618 A1 * 6/2002 Gaber ..... F41G 1/30 42/123
2003/0086165 A1 * 5/2003 Cross ..... G02B 23/10 359/399
2015/0345905 A1 * 12/2015 Hancosky ..... F41G 3/323 42/113
2016/0102943 A1 * 4/2016 Teetzel ..... F41G 1/35 42/113
2021/0396490 A1 * 12/2021 Pischke ..... F41G 1/30
(Continued)

FOREIGN PATENT DOCUMENTS

JP 6929644 B2 9/2021
WO WO-2023164531 A1 * 8/2023 ..... F41G 1/30

OTHER PUBLICATIONS

HE507COMP-GR, Holosun, pp. 1-6, Last accessed Jan. 18, 2024, <https://holosun.com/products/reflex-sight/507/he507comp-gr.html>.
(Continued)

*Primary Examiner* — Samir Abdosh
(74) *Attorney, Agent, or Firm* — Patterson + Sheridan, LLP

(57) ABSTRACT

The present disclosure relates to adjustable reticles for sighting operations, and related methods, apparatus, and sight devices. In one or more embodiments, a sight device includes an illuminator. The illuminator includes a first illuminator section operable to illuminate a first section of a reticle, and a second illuminator section operable to illuminate a second section of the reticle radially outwardly of the first section. An outer dimension of the first section is a first ratio of an inner dimension of the second section, and the first ratio is less than 1:3.

20 Claims, 7 Drawing Sheets

(56) References Cited

U.S. PATENT DOCUMENTS

2022/0381536 A1* 12/2022 York ..... F41G 1/30
2024/0068777 A1* 2/2024 Havens ..... G02B 27/026

OTHER PUBLICATIONS

HE507COMP-GR/HS507COMP User's Manual, Holosun, pp. 1-2, Last Accessed Jan. 18, 2024, <https://holosun.com/uploads/20230620/e638508aafbf2f05b2d6199003dfa7a5.pdf>.
Holosun HS507K X2 Reflex Sight, Cabela's, pp. 1-5, Last Accessed Jan. 18, 2024, <www.cabelas.comshopenholosun-hs507k-x2-reflex-sight>.
Trijicon Acog 1.5 X 24 Scope Dual Illuminated Triangle Reticle, Red, ETACTICALLIFE, pp. 1-6, Last Accessed Jan. 18, 2024, <https://www.etacticallife.com/products/trijicon-acog-1-5-x-24-scope-dual-illuminated-triangle-reticle-red>.
Trijicon ACOG 3.5×35 Scope, Dual Illuminated Red Circle / Chevron BAC Reticle, Lockhart Tactical, pp. 1-6, Last Accessed Jan. 18, 2024, <https://www.lockharttactical.com/product/product/trijicon-acog-3-5x35-scope,-dual-illuminated-red-circle-chevron-bac-reticle>.
Fitch, P. E., "Review: Holosun 507 Comp Dot Sight", NRA Shooting Illustrated, Aug. 28, 2023, pp. 1-3, Last Accessed Jan. 18, 2024, <https://www.shootingillustrated.com/content/review-holosun-507-comp-dot-sight/>.
ROMEO5XDR 1X20 MM, SIG Sauer, pp. 1-5, Last Accessed Jan. 18, 2024, <https://www.sigsauer.com/romeo5xdr-1x20-mm.html>.
Trijicon ACOG 4×32 BAC Riflescope—.223 / 5.56 BDC, Trijicon, pp. 1-2, Last Accessed Jan. 18, 2024, <https://www.trijicon.com/products/details/ta31a>.
"Trijicon Adds VCOG To Its Line Of Magnified Optics", A Twobirds Flying Publications, May 2, 2013, pp. 1-3, Last Accessed Jan. 18, 2024, <https://twobirdsflyingpub.wordpress.com/2013/05/02/trijicon-adds-vcog-to-its-line-of-magnified-optics/>.
Dolbee, Dave, "Awesome Optics for ARs", The Shooter's Log, Cheaper Than Dirt, Nov. 18, 2012, pp. 1-18, Last Accessed Jan. 18, 2024, <https://blog.cheaperthandirt.com/clear-choices-ar-optics/>.
FastFire 4 Cover, Burris, pp. 1-3, Last Accessed Jan. 18, 2024, <https://www.burrisoptics.com/fastfire-4-cover>.
FastFire 4 Multi-Reticles, Burris pp. 1-2, Last Accessed Jan. 18, 2024, <https://www.burrisoptics.com/reticles/fastfire-4-multi-reticles>.
FastFire 4—Fastfire Red Dot Reflex Sight, Burris, pp. 1-20, Last Accessed Jan. 18, 2024, <https://www.burrisoptics.com/red-dots/fastfire-4>.
All the Reticles | 507 Comp, Roger Barrera, YouTube Shorts, Feb. 14, 2023, p. 1, Last Accessed Jan. 18, 2024, <https://www.youtube.com/shorts/k38hfeJ1CA0>.
507 Comp Overview & Reticles, Freedom Gorilla, YouTube Shorts, Jun. 23, 2023, p. 1, Last Accessed Jan. 18, 2024, <https://www.youtube.com/shorts/mWk1drV8QIY>.

* cited by examiner

ADJUSTABLE RETICLES FOR SIGHTING OPERATIONS, AND RELATED METHODS, APPARATUS, AND SIGHT DEVICES

BACKGROUND

Field

The present disclosure relates to adjustable reticles for sighting operations, and related methods, apparatus, and sight devices.

Description of the Related Art

Reticles used in sighting operations (such as shooting operations) can be limited with respect to modularity such that it can be difficult for users to sight targets at a variety of distances and a variety of speeds. For example, it can be difficult for users to shoot targets at a variety of distances, a variety of shot split times, a variety of target transition speeds, and a variety of target acquisition speeds. Reticles can also be difficult for a user to align and/or level for accurate sighting. Moreover, reticles used in sighting operations can be distorted, blurry, and/or obstructive for a target, which hinders a user's accuracy and/or speed.

Therefore, a need exists for improved reticles and sight devices.

SUMMARY

The present disclosure relates to adjustable reticles for sighting operations, and related methods, apparatus, and sight devices.

In one or more embodiments, a sight device includes an illuminator. The illuminator includes a first illuminator section operable to illuminate a first section of a reticle, and a second illuminator section operable to illuminate a second section of the reticle radially outwardly of the first section. An outer dimension of the first section is a first ratio of an inner dimension of the second section, and the first ratio is less than 1:3.

In one or more embodiments, a sight device includes an illuminator. The illuminator includes a first illuminator section operable to illuminate a first section of a reticle, and a second illuminator section operable to illuminate a second section of the reticle radially outwardly of the first section at a spacing from the first section. The second section defines a gap radially outwardly of the spacing. A dimension of the gap is less than an outer dimension of the first section.

In one or more embodiments, a non-transitory computer readable medium includes instructions that when executed cause a plurality of operations to be conducted. The plurality of operations include initiating an illumination of a first section of a reticle, and initiating an illumination of a second section of the reticle radially outwardly of the first section after the initiating of the illumination of the first section. The illumination of the second section is initiated while the first section is illuminated. The plurality of operations include ending the illumination of the second section, and initiating an illumination of a point section of the reticle radially outwardly of the second section after the ending of the illumination of the second section. The point section includes an outer point, and the illumination of the point section is initiated while the first section is illuminated.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The present disclosure relates to adjustable reticles for sighting operations, and related methods, apparatus, and sight devices. In one or more embodiments, a sight device is operable to view a reticle that is adjustable to increase and/or decrease a size of a central region (such as a central dot) of the reticle. The sight devices can be mounted to a variety of devices where aiming is used in operation of the devices. For example, the sight devices can be mounted to projectile launching devices, such as firearms (e.g., pistols, rifles, and/or shotguns), airguns, bows (e.g., crossbows), and/or airsoft guns. The present disclosure contemplates that the sight devices described herein can be mounted to other devices.

The disclosure contemplates that terms such as "couples," "coupling," "couple," and "coupled" may include but are not limited to bonding, embedding, welding, fusing, melting together, interference fitting, and/or fastening such as by using fasteners such as bolts, threaded connections, pins, and/or screws. The disclosure contemplates that terms such as "couples," "coupling," "couple," and "coupled" may include but are not limited to integrally forming. The disclosure contemplates that terms such as "couples," "coupling," "couple," and "coupled" may include but are not limited to direct coupling and/or indirect coupling, such as indirect coupling through components such as links, plates, blocks, and/or frames.

Figure 1:
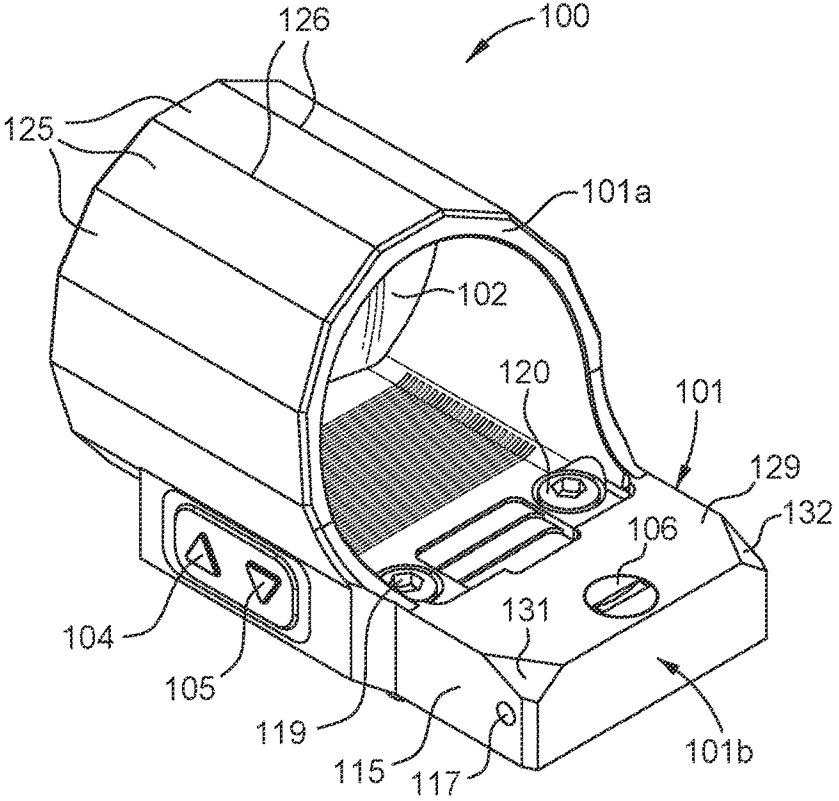
FIG. 1 is a schematic back perspective view of a sight device, according to one or more embodiments.

FIG. 1 is a schematic back perspective view of a sight device 100, according to one or more embodiments.

Figure 2:
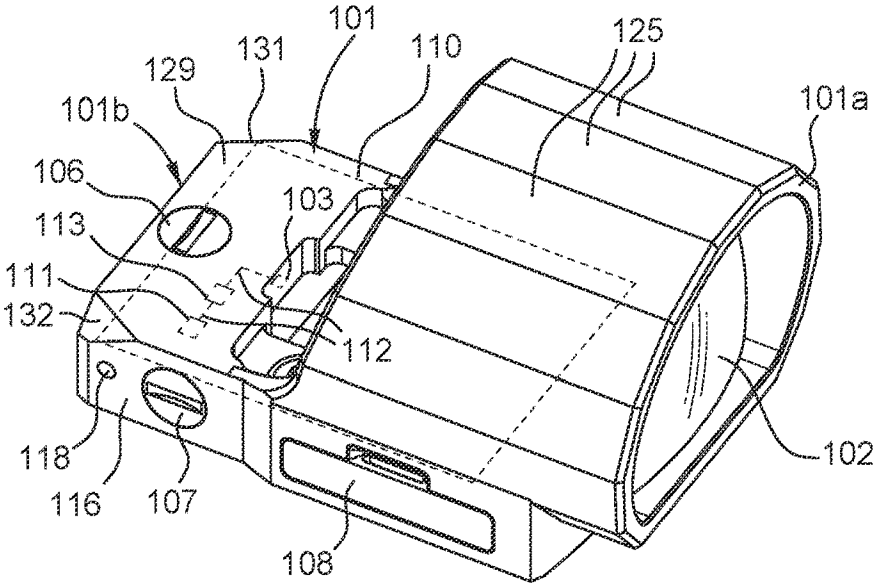
FIG. 2 is a schematic front perspective view of the sight device shown in FIG. 1, according to one or more embodiments.

FIG. 2 is a schematic front perspective view of the sight device 100 shown in FIG. 1, according to one or more embodiments.

FIGS. 1 and 2 are described together. The sight device 100 includes a sight housing 101 at least partially supporting a view panel 102 and an illuminator 103. The view panel 102 can include, for example, a lens (such as a glass panel). The view panel 102 is curved in shape. In one or more embodiments, the view panel 102 includes a beam splitter. The beam splitter can transmit a first light (such as infrared radiation) and reflect a second light (such as visible light, e.g., visible red light or visible green light). For example, the view panel 102 can reflect visible light illuminated onto the view panel 102 using the illuminator 103. The present disclosure contemplates that other view panels (such as displays) may be used in relation to the subject matter of the present application.

The illuminator 103 is connected to a controller 110 that controls methods, such as the operations of the methods described herein. For example, the controller 110 controls the operation of the illuminator 103. The controller 110 is disposed at least partially within the sight housing 101. The controller 110 includes a central processing unit (CPU) 113 (e.g., a processor), a memory 111 containing instructions, and support circuits 112. The controller 110 controls various items directly, or via other computers and/or controllers. In one or more embodiments, the controller 110 is communicatively coupled to dedicated controllers, and the controller 110 functions as a central controller.

The controller 110 can include any form of a general-purpose computer processor that is used for controlling sight devices, and sub-processors thereon or therein. The memory 111, or non-transitory computer readable medium, can include one or more of a readily available memory such as random access memory (RAM), dynamic random access memory (DRAM), static RAM (SRAM), and synchronous dynamic RAM (SDRAM (e.g., DDR1, DDR2, DDR3, DDR3L, LPDDR3, DDR4, LPDDR4, and the like)), read only memory (ROM), floppy disk, hard disk, flash drive, or any other form of digital storage, local or remote. In one or more embodiments, the memory 111 includes a chip, for example a chip-on-board, such as a chip including silicon and/or germanium. The support circuits 112 of the controller 110 are coupled to the CPU 113 and/or the illuminator 103 for supporting the CPU 113 and/or the illuminator 103. The support circuits 112 can include cache, power supplies, clock circuits, input/output circuitry and subsystems, and the like. Operational parameters (e.g., brightness settings) and operations are stored in the memory 111 as a software routine that is executed or invoked to turn the controller 110 into a specific purpose controller to control the operations of the sight devices described herein. The controller 110 is configured to conduct any of the operations described herein. The instructions stored on the memory 111, when executed, cause one or more of the operations described herein to be conducted in relation to the sight device 100.

In one or more embodiments, the CPU 113, the memory 111, and the support circuits 112 are part of a printed circuit board (PCB). The illuminator 103 can be mounted to the PCB or spaced from the PCB while connected to the PCB.

The various operations described herein can be conducted automatically using the controller 110, or can be conducted automatically and/or manually with certain operations conducted by a user. As an example, a user can press and hold a first button 104 for a predetermined time (such as 2-3 seconds) to initiate a signal to the controller 110, and in response to the signal the controller 110 turns on the illuminator 103. As another example, a user can press the first button 104 to initiate a signal to the controller 110, and in response to the signal the controller 110 increases a brightness setting for the illuminator 103. As another example, a user can press a second button 105 to initiate a signal to the controller 110, and in response to the signal the controller 110 decreases a brightness setting for the illuminator 103. As a further example, a user can press and hold the second button 105 for a predetermined time (such as 2-3 seconds) to initiate a signal to the controller 110, and in response to the signal the controller 110 turns off the illuminator 103. As an additional example, a user can press and hold the first button 104 for a predetermined time (such as 2-3 seconds) while the illuminator 103 is on to initiate a signal to the controller 110, and in response to the signal the controller 110 cycles the illuminator 103 through a plurality of operations (such as the operations shown in FIGS. 12A-12E) until the first button 104 is released. In one or more embodiments, the first button 104 and the second button 105 are triangular in shape. In one or more embodiments, the first button 104 is oriented in a first direction to point toward the view panel 102 (e.g., in an upward direction), and the second button 105 is oriented in an opposite second direction to point away from the view panel 102 (e.g., in a downward direction).

A first adjustment knob 106 can adjust a first setting (e.g., a vertical positon, such as an elevation) of the illuminator 103, and a second adjustment knob 107 can adjust a second setting (e.g., a horizontal positon, such as a windage) of the illuminator 103. A battery compartment 108 covers and/or supports a battery that supplies electrical power to the controller 110 and the illuminator 103. The sight housing 101 includes a panel section 101*a* disposed about the view panel 102 and a flange section 101*b* extending relative to the panel section 101*a*. The flange section 101*b* includes a first outer side surface 115 and a second outer side surface 116 opposing the first outer side surface 115. The flange section 101*b* includes a plurality of tapered outer surfaces 131, 132 extending between the outer side surfaces 115, 116 and a top surface 129 of the flange section 101*b*. A first fastener opening 117 is formed in the first outer side surface 115, and a second fastener opening 118 is formed in the second outer side surface 116. One or more fasteners 119, 120 (two are shown) extend through the sight housing 101 to couple the sight housing 101 to a firearm component (such as a slide, a frame, a receiver, and/or a rail system of a firearm) or a mount that couples to the firearm component. As an example, the fasteners 119, 120 can thread into a slide, a receiver, or a frame of a firearm. As another example, the fasteners 119, 120 can thread into a mount that couples to a firearm component. In one or more embodiments, the one or more fasteners 119, 120 include screws.

Figure 3:
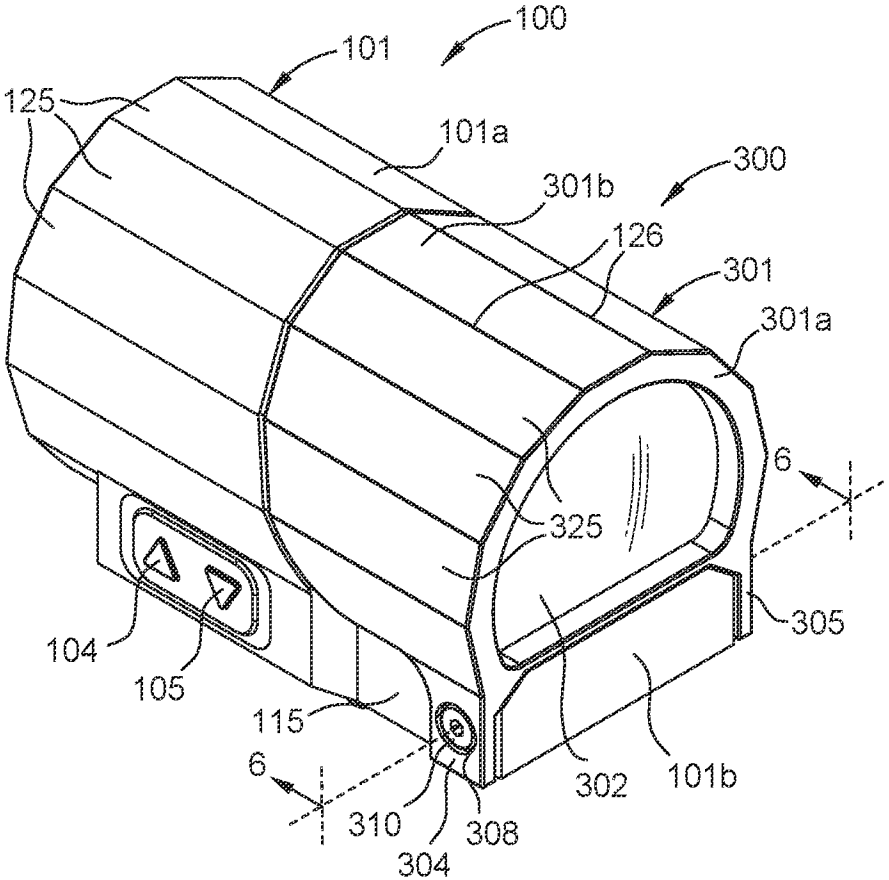
FIG. 3 is a schematic back perspective view of the sight device and a cover coupled to the sight housing 101, according to one or more embodiments.

FIG. 3 is a schematic back perspective view of the sight device 100 and a cover 300 coupled to the sight housing 101, according to one or more embodiments.

Figure 4:
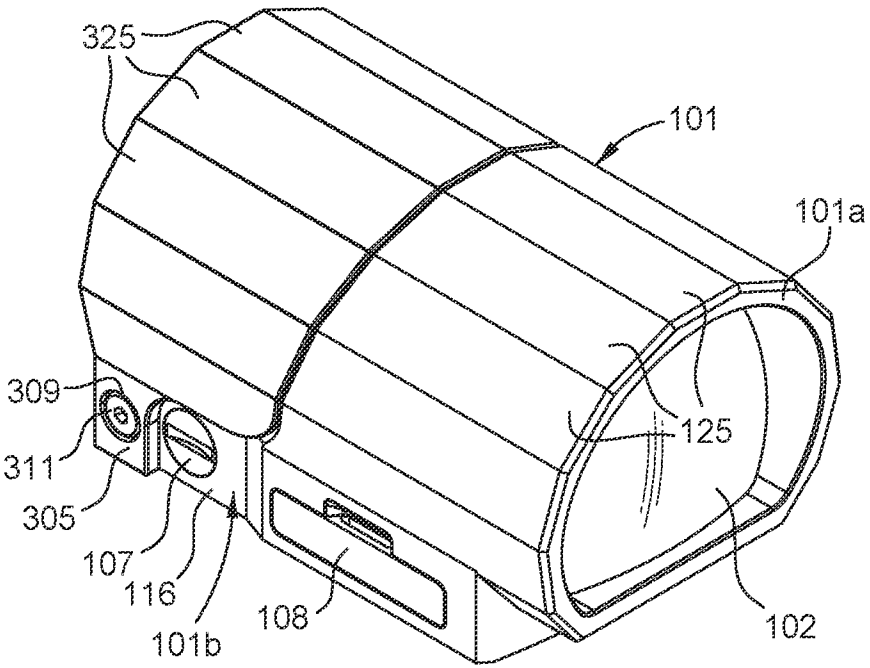
FIG. 4 is a schematic front perspective view of the sight device and the cover shown in FIG. 3, according to one or more embodiments.

FIG. 4 is a schematic front perspective view of the sight device 100 and the cover 300 shown in FIG. 3, according to one or more embodiments.

FIGS. 3 and 4 are described together. The cover 300 includes a cover housing 301 at least partially supporting a second view panel 302. The cover housing 301 includes a panel section 301*a* disposed about the second view panel 302 and a flange section 301*b* extending relative to the panel section 301*a*. The flange section 301*b* of the cover housing 301 interfaces with (e.g., abuts against) the panel section 101*a* of the sight housing 101 when the cover housing 301 is supported on the sight housing 101. The second view panel 302 is flat in shape and allows the visible light reflected by the view panel 102 to transmit therethrough and to a user's eye. The cover 300 facilitates preventing fluid (e.g., sweat and/or water, such as rain) and debris (such as dust, dirt, silt, and/or clothing lint) from obstructing the view panel 102 and/or the illuminator 103. The cover 300 includes a first extension 304 (e.g., a first plate) and a second extension 305 (e.g., a second plate) extending relative to the panel section 301*a* of the cover housing 301. The first extension 304 and the second extension 305 are spaced apart from each other by the flange section 101*b* of the sight housing 101. At least part of the panel section 301*a* of the cover housing 301 extends between the first extension 304 and the second extension 305. The first extension 304 extends along the first outer side surface 115 and the second extension 305 extends along the second outer side surface 116. The cover 300 includes a first opening 308 formed in the first extension 304 and a second opening 309 formed in the second extension 305. A first fastener 310 (e.g., a first screw) disposed in the first opening 308 extends through the first extension 304 and threads into the first fastener opening 117 of the sight housing 101. A second fastener 311 (e.g., a second screw) disposed in the second opening 309 extends through the second extension 305 and threads into the second fastener opening 118 of the sight housing 101. The first and second fasteners 310, 311. The first and second fasteners 310, 311 are oriented parallel to the second view panel 302.

The cover 300 includes a plurality of tapered surfaces 331, 332 extending between the extensions 304, 305 and the panel section 301*a*. The tapered surfaces 331, 332 interface with the tapered outer surfaces 131, 132 of the sight housing 101 to facilitate guiding the cover 300 onto the sight housing 101 and retaining the cover 300 on the sight housing 101 during operation.

The extensions 304, 305 and/or the orientations of the first and second fasteners 310, 311 facilitate reliable coupling of the cover 300 to the sight housing 101 throughout operation of the firearm to which the sight device 100 is mounted. For example, the extensions 304, 305 and/or the orientations of the first and second fasteners 310, 311 reduce or eliminate the loosening and dismounting of the cover 300 from the sight housing 101 under multiple recoil impulses over time. The extensions 304, 305 and/or the orientations of the first and second fasteners 310, 311 facilitate a reduced footprint for the sight device 100, which facilitates enhanced modularity and reduced interference with other firearm components (such as mechanical sights). The extensions 304, 305 and/or the orientations of the first and second fasteners 310, 311 facilitate ease of installation and removal of the cover 300 to and from the sight housing 100 while the sight device 100 is mounted to the firearm, such as when mechanical sight(s) of the firearm are adjacent to or near the sight device 100.

Figure 5:
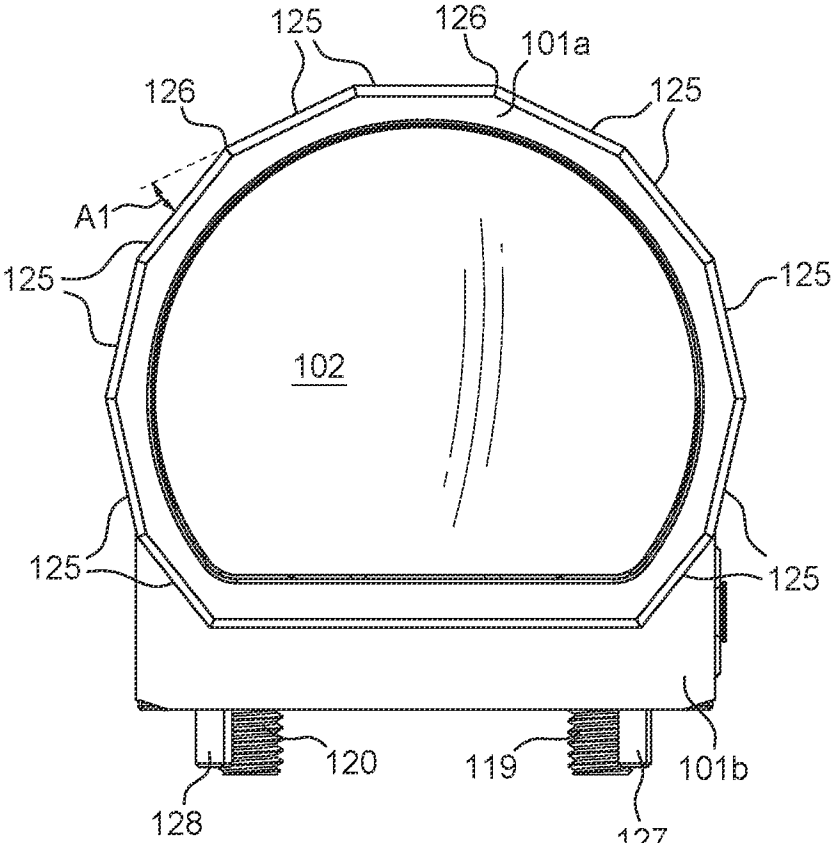
FIG. 5 is a schematic front view of the sight device shown in FIGS. 1-4, according to one or more embodiments.

FIG. 5 is a schematic front view of the sight device 100 shown in FIGS. 1-4, according to one or more embodiments.

The panel section 101*a* of the sight housing 101 includes a plurality of outer surfaces 125 (eleven are shown in FIG. 5). A different number (lower or higher) of the outer surfaces 125 can be used. One or more additional outer surfaces can be used that are oriented differently than the outer surfaces 125. The outer surfaces 125 are disposed about the view panel 102. In one or more embodiments, the outer surfaces 125 are planar. The outer surfaces 125 are oriented to intersect each other and form a plurality of outer edges 126 between adjacent outer surfaces 125. The outer surfaces 125 are oriented such that an angle A1 is defined between adjacent outer surfaces 125. At least two (such as two or all) of the outer surfaces 125 are oriented to define the angle A1 between adjacent outer surfaces 125. The angle A1 is less than 35 degrees, such as 30 degrees or less. In one or more embodiments, the angle A1 is less than 30 degrees. In one or more embodiments, the angle A1 is within a range of 20 degrees to 30 degrees. In one or more embodiments, the angle A1 is within a range of 24 degrees to 28 degrees, such as about 26 degrees. The outer surfaces 125 facilitate enhancing durability (e.g., impact resistance and/or reduced wear) and operational lifespans of the sight device 100 while enhancing the aesthetic appeal of the sight device 100.

One or more alignment tabs 127, 128 (two are shown) can be used to align the sight housing 101 relative to the mount or firearm component prior coupling the sight housing 101 to the mount or firearm component using the one or more fasteners 119, 120.

Figure 6:
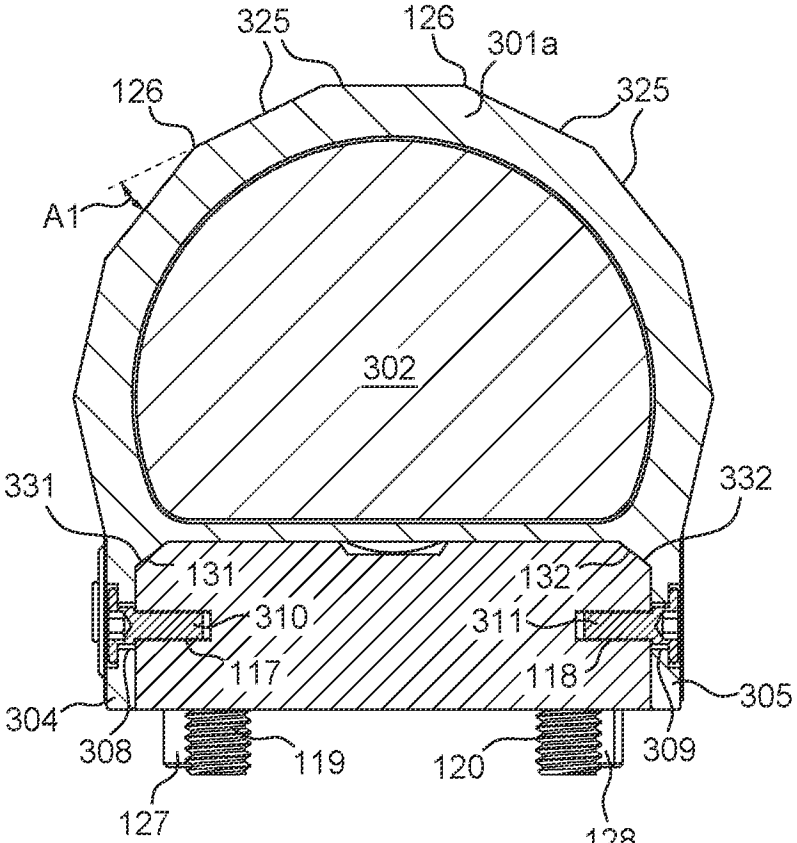
FIG. 6 is a schematic cross-sectional view of the sight device and the cover along Section 6-6 shown in FIG. 3, according to one or more embodiments.

FIG. 6 is a schematic cross-sectional view of the sight device 100 and the cover 300 along Section 6-6 shown in FIG. 3, according to one or more embodiments.

The panel section 301*a* of the cover housing 301 includes a plurality of outer surfaces 325 (nine are shown in FIG. 6). A different number (lower or higher) of the outer surfaces 325 can be used. One or more additional outer surfaces can be used that are oriented differently than the outer surfaces 325. The outer surfaces 325 are disposed about the second view panel 302. The outer surfaces 325 align with the outer surfaces 125. The outer surfaces 325 are similar to the outer surfaces 125 and include one or more aspects, features, properties, and/or operations thereof. For example, the outer surfaces 325 are oriented such that the angle A1 is defined between adjacent outer surfaces 325. The outer surfaces 325 facilitate enhancing durability (e.g., impact resistance and/or reduced wear) and operational lifespans of the cover 300 while enhancing the aesthetic appeal of the cover 300.

Figure 7:
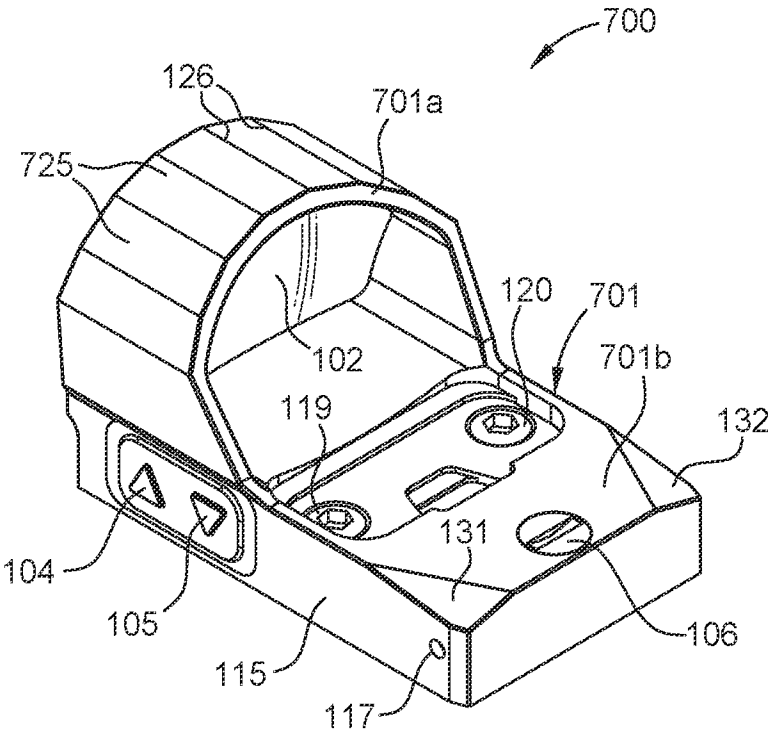
FIG. 7 is a schematic back perspective view of a sight device, according to one or more embodiments.

FIG. 7 is a schematic back perspective view of a sight device 700, according to one or more embodiments.

Figure 8:
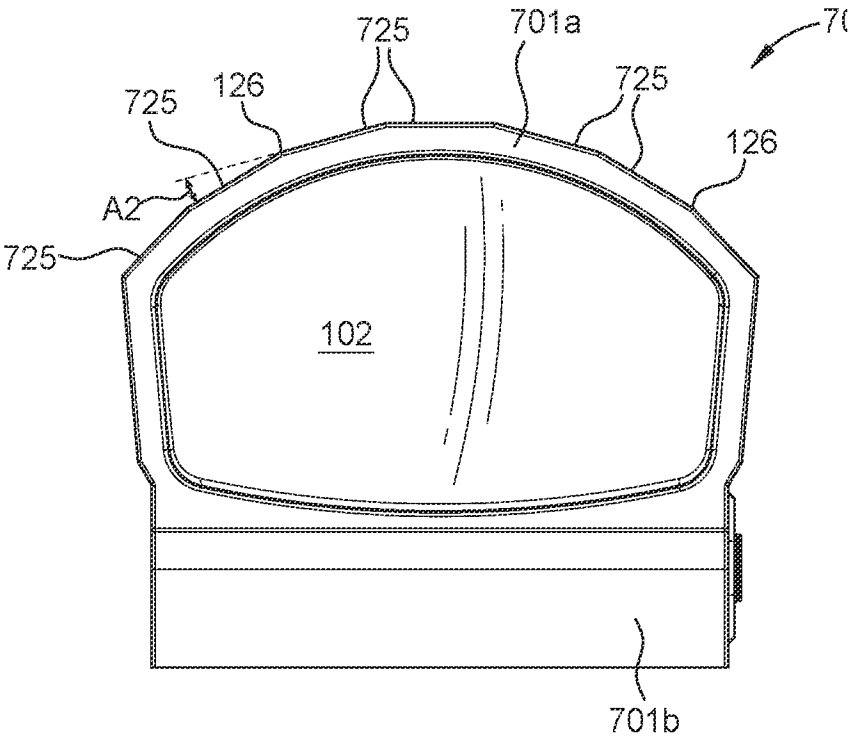
FIG. 8 is a schematic front view of the sight device shown in FIG. 7, according to one or more embodiments.

FIG. 8 is a schematic front view of the sight device 700 shown in FIG. 7, according to one or more embodiments.

FIGS. 7 and 8 are described together. The sight device 700 is similar to the sight device 100 shown in FIGS. 1-6 and includes one more aspects, features, components, operations, and/or properties thereof. For example, the sight device 700 can include the illuminator 103 and/or the controller 110 among other features and components.

The sight device 700 includes a sight housing 701 that includes a panel section 701*a* and a flange section 701*b*.

The panel section 701*a* of the sight housing 701 includes a plurality of outer surfaces 725 (seven are shown in FIG. 7). A different number (lower or higher) of the outer surfaces 725 can be used. One or more additional outer surfaces can be used that are oriented differently than the outer surfaces 725. The outer surfaces 725 are disposed about the view panel 102. In one or more embodiments, the outer surfaces 725 are planar. The outer surfaces 725 are oriented such that an angle A2 is defined between adjacent outer surfaces 725. At least two (such as two or all) of the outer surfaces 725 are oriented to define the angle A2 between adjacent outer surfaces 725. The angle A2 is less than 35 degrees, such as 30 degrees or less. In one or more embodiments, the angle A2 is less than 20 degrees. In one or more embodiments, the angle A2 is within a range of 10 degrees to 20 degrees. In one or more embodiments, the angle A2 is within a range of 13 degrees to 17 degrees, such as about 15 degrees.

Figure 9:
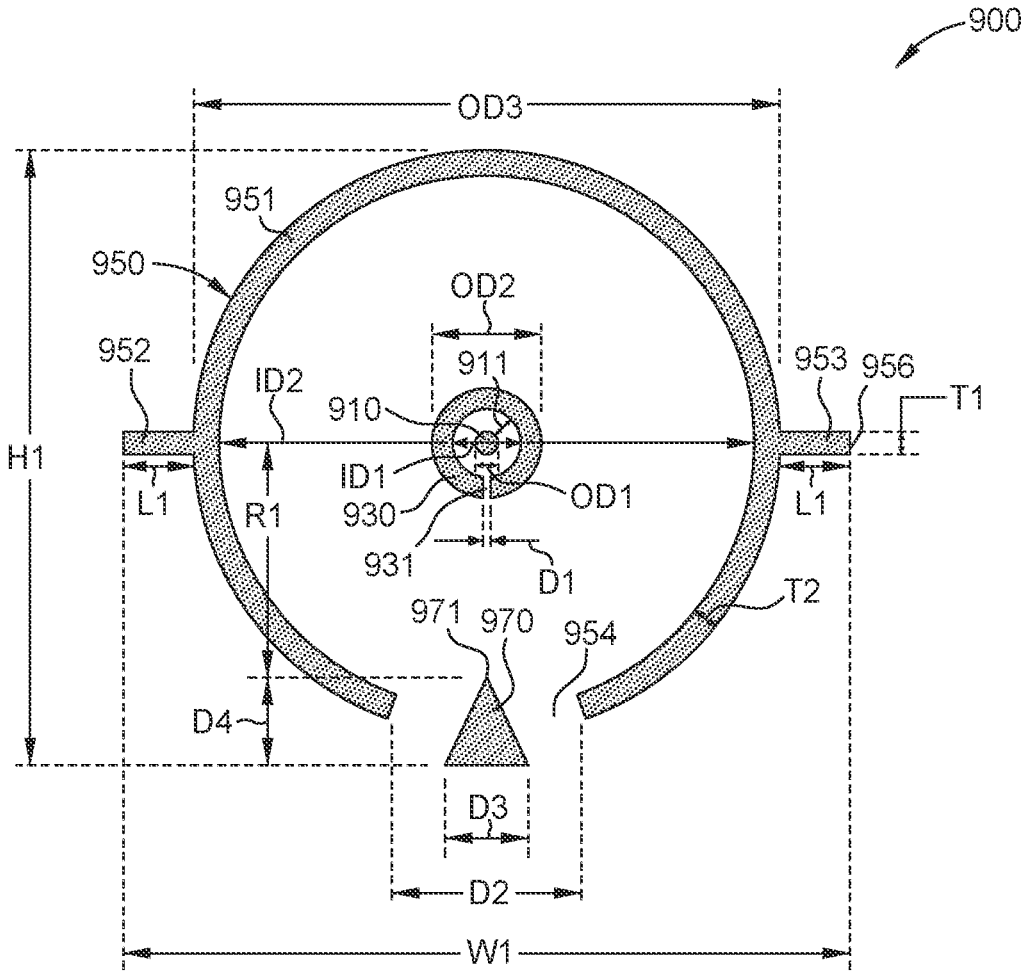
FIG. 9 is a schematic diagram view of a reticle, according to one or more embodiments.

FIG. 9 is a schematic diagram view of a reticle 900, according to one or more embodiments. Sight device(s) can be operable to view the reticle 900. The reticle 900 can be illuminated as visible light using the illuminator 103 onto the view panel 102 of the sight device 100 or the sight device 700. Although the sight devices 100, 700 are described as reflex sights, the reticle 900 can be illuminated and/or viewable on a variety of other sight devices. For example, the reticle 900 can be illuminated and/or viewable as part of a wire reticle, an etched reticle, and/or a fiber reticle. As another example, the reticle 900 can be at least partially illuminated through a view panel to a user's eye(s) in addition to or in place of reflecting the reticle 900 at least partially off of the view panel 102. As a further example, the reticle 900 can be illuminated and/or viewable as part of a holographic sight and/or a magnifying scope. As another example, the reticle 900 can be illuminated and/or viewable on a display, such as a display screen (for example an organic light-emitted diode (OLED) display screen). Other sight devices are contemplated. The present disclosure contemplates that the reticle 900 can be viewable in a manner that is not illuminated. For example, the reticle 900 can be a wire reticle and/or an etched reticle.

The reticle 900 includes a first section 910, a second section 930 disposed radially outwardly of the first section 910, and a third section 950 disposed radially outwardly of the second section 930. The sections 910, 930, 950, 970 of the reticle 900 are shown with surface shading in FIG. 9 for visual clarity purposes. The sections 910, 930, 950, 970 of the reticle 900 can be filled with solid color(s). For example, the sections 910, 930, 950, 970 of the reticle 900 can be filled with visible red light and/or visible green light.

An outer dimension OD1 of the first section 910 is a first ratio of an inner dimension ID1 of the second section 930, and the first ratio is less than 1:3 (e.g., less than about 0.33333). In one or more embodiments, the first ratio is 0.31 or less, such as within a range of 0.29 to 0.31. A spacing 911 is between the outer dimension OD1 of the first section 910 and the inner dimension ID1 of the second section 930. The spacing 911 is a second ratio of the outer dimension OD1 of the first section, and the second ratio is greater than 1.0. The second ratio is less than 1.5, such as less than 1.3. In one or more embodiments, the second ratio is within a range of 1.10 to 1.2. In one or more embodiments, the second ratio is within a range of 1.15 to 1.17, such as about 1.16071. The spacing 911 surrounds the first section 910. The second section 930 partially surrounds the first section 910.

The spacing 911 is a third ratio of an inner dimension ID2 of the third section 950, and the third ratio is 0.05 or less. In one or more embodiments, the third ratio is within a range of 0.04 to 0.05. In one or more embodiments, the third ratio is within a range of 0.045 to 0.047, such as about 0.046. An outer dimension OD2 of the second section 930 is a fourth ratio of the outer dimension OD1 of the first section 910, and the fourth ratio is greater than 5.0. In one or more embodiments, the fourth ratio is within a range of 5.05 to 5.15, such as about 5.1.

The outer dimension OD1 of the first section 910 is a fifth ratio of an inner dimension ID2 of the third section 950, and the fifth ratio is 0.05 or less. In one or more embodiments, the fifth ratio is within a range of 0.035 to 0.05. In one or more embodiments, the fifth ratio is within a range of 0.035 to 0.045, such as about 0.04. The present disclosure contemplates that the use of "about" herein can encompass a difference of 5% or less. The inner dimension ID1 of the second section 930 is a sixth ratio of the inner dimension ID2 of the third section 950, and the sixth ratio less than 0.2. In one or more embodiments, the sixth ratio is within a range of 0.1 to 0.15, such as about 0.13.

The second section 930 defines a gap 931 radially outwardly of the spacing 911. A dimension D1 of the gap 931 is less than the outer dimension OD1 of the first section 910. The dimension D1 of the gap 931 is a seventh ratio of the outer dimension OD1 of the first section OD1, and the seventh ratio is less than 1.5. In one or more embodiments, the seventh ratio is greater than 0.4 and less than 1.0. In one or more embodiments, the seventh ratio is less than 0.6. In one or more embodiments, the seventh ratio is within a range of 0.5 to 0.55, such as within a range of 0.53 to 0.54. The dimension D1 of the gap 931 is an eighth ratio of the spacing 911, and the eighth ratio is less than 1.3. In one or more embodiments, the eighth ratio is less than 1.0, such as less than 0.6 or less than 0.5. In one or more embodiments, the eighth ratio is within a range of 0.4 to 0.5, such as within a range of about 0.45 to 0.47. The dimension D1 of the gap 931 is a ninth ratio of the inner dimension ID1 of the second section 930, and the ninth ratio is less than 0.5. In one or more embodiments, the ninth ratio is less than 0.3, such as less than 0.2. In one or more embodiments, the ninth ratio is within a range of 0.1 to 0.2, such as within a range of about 0.15 to 0.17.

The dimension D1 of the gap 931 is a tenth ratio of the inner dimension ID2 of the third section 950, and the tenth ratio is less than 0.06. In one or more embodiments, the tenth ratio is less than 0.05, such as less than 0.03. In one or more embodiments, the tenth ratio is within a range of 0.01 to 0.03, such as within a range of about 0.015 to 0.025. In one or more embodiments, the tenth ratio is within a range of 0.020 to 0.022, such as about 0.021.

The reticle 900 includes a fourth section 970 at least partially aligned with the third section 950 at a radial location. The third section 950 at least partially defines a gap 954, and the fourth section 970 is disposed at least partially in the gap 954. The fourth section 970 includes an outer point 971 disposed radially between the third section 950 and the second section 930. In one or more embodiments, the outer point 971 is an apex of the fourth section 970. The outer point 971 is disposed at a radial distance R1. The radial distance R1 is an eleventh ratio of the inner dimension ID2 of the third section 950. The eleventh ratio is less than 0.5 and equal to or greater than 0.4. The radial distance R1 is a twelfth ratio of the outer dimension OD2 of the second section 930, and the twelfth ratio is at least 2.0. The gap 931 of the second section 930 is aligned radially between the first section 910 and the outer point 971 of the fourth section 970. The gap 954 of the third section 950 has a dimension D2. The fourth section 970 has a first dimension D3 and a second dimension D4 oriented perpendicularly to the first dimension D3.

The spacing 911 is a thirteenth ratio of the inner dimension ID1 of the second section 930. The thirteenth ratio is less than 0.5, such as less than 0.4. In one or more embodiments, the thirteenth ratio is greater than 1:3 (e.g., greater than about 0.33333). In one or more embodiments, the thirteenth ratio is within a range of 0.30 to 0.40, such as about 0.3495.

The third section 970 includes an outer dimension OD3. In one or more embodiments, the third section 950 includes an arcuate portion 951, a first side portion 952 extending linearly relative to a first side of the arcuate portion 951, and a second side portion 953 extending linearly relative to a second side of the arcuate portion 951. The first and second side portions 952, 953 respectively have a thickness T1. In one or more embodiments, the dimension D2 is between two end points of the arcuate portion 951, and the two end points are in the middle of a thickness T2 of the arcuate portion 951. The reticle 900 has an overall height H1 and an overall width W1.

In one or more embodiments, the outer dimension OD1 is an outer diameter of the first section 910, the inner dimension ID1 is an inner diameter of the second section 930, the outer dimension OD2 is an outer diameter of the second section 930, the inner dimension ID2 is an inner diameter of the third section 950, and/or the outer dimension OD3 is an outer diameter of the third section 950. In one or more embodiments, the dimension D1 is a width of the gap 931, the dimension D2 is a width of the gap 954, the first dimension D3 is a width of the fourth section 970, and/or the second dimension D4 is a height of the fourth section 970.

In one or more embodiments, the first section 910 includes a dot, the second section 930 includes a first arc, the third section 950 includes a second arc, and/or the fourth section 970 includes a triangle. The present disclosure contemplates that other shapes may be used. For example, the fourth section 970 can include a chevron, an arc, or a star. Other shapes are contemplated.

The outer dimension OD1 of the first section 910 is within a range of 25 microns to 30 microns, such as about 28 microns. In one or more embodiments, the outer dimension OD1 of the first section 910 is about 2.5 minutes-of-angle (MOA). The inner dimension ID1 of the second section 930 is 100 microns or less. The inner dimension ID1 of the second section 930 is within a range of 85 microns to 100 microns, such as about 93 microns. In one or more embodiments, the inner dimension ID1 of the second section 930 is about 8 MOA. The outer dimension OD2 of the second section 930 is within a range of 130 microns to 155 microns, such as about 143 microns. In one or more embodiments, the outer dimension OD2 of the second section 930 is about 12.5 MOA. The inner dimension ID2 of the third section 950 is within a range of 700 microns to 720 microns, such as about 707 microns. In one or more embodiments, the inner dimension ID2 of the third section 950 is about 62 MOA. The outer dimension OD3 of the third section 950 is within a range of 750 microns to 790 microns, such as about 767 microns. In one or more embodiments, the outer dimension OD3 of the third section 950 is about 68 MOA. The spacing 911 is 30 microns or less. The spacing 911 is within a range of 25 microns to 30 microns, such as about 32.5 microns. In one or more embodiments, the spacing 911 is about 2.75 MOA. The dimension D1 of the gap 931 is 20 microns or less. The dimension D1 of the gap 931 is within a range of 10 microns to 20 microns, such as about 0.015 microns. In one or more embodiments, the dimension D1 of the gap 931 is about 1.3 MOA. In one or more embodiments, the spacing 911 is omitted. In such an embodiment, the inner dimension ID1 of the second section 930 can be equal to the outer dimension OD1 of the first section 910. In one or more embodiments, the gap 931 is omitted. In such an embodiment, the second section 930 can include a complete ring (e.g., a complete circular ring) that surrounds the first section 910. In one or more embodiments, the gap 954 is omitted on one or both sides of the fourth section 970. In such an embodiment, the arcuate portion 951 of the third section 950 can connect to the fourth section 970 on one or both sides of the fourth section 970. In one or more embodiments, the fourth section 970 is omitted and/or the arcuate portion 951 of the third section 950 includes a complete ring (e.g., a complete circular ring) that surrounds the second section 930.

The dimension D2 of the gap 954 is within a range of 240 microns to 265 microns, such as about 252 microns. In one or more embodiments, the dimension D2 of the gap 954 is about 21 MOA. The first dimension D3 of the fourth section 970 is within a range of 100 microns to 120 microns, such as about 107 microns. In one or more embodiments, the first dimension D3 is about 9 MOA. The second dimension D4 of the fourth section 970 is within a range of 110 microns to 130 microns, such as about 117 microns. In one or more embodiments, the second dimension D4 is about 10 MOA. The radial distance R1 is within a range of 290 microns to 320 microns, such as about 305 microns. In one or more embodiments, the radial distance R1 is about 26 MOA. The thickness T1 is within a range of 25 microns to 35 microns, such as about 30 microns. In one or more embodiments, the thickness T1 is about 2.5 MOA. The overall width W1 is within a range of 940 microns to 965 microns, such as about 953 microns. In one or more embodiments, the overall width W1 is about 84 MOA. The overall height H1 is within a range of 790 microns to 820 microns, such as about 805 microns. In one or more embodiments, the overall height H1 is about 71 MOA. A length L1 of the respective first side portion 952 and second side portion 953 is within a range of 150 microns to 220 microns, such as 180 microns to 190 microns, for example about 186 microns. In one or more embodiments, the length L1 is within a range of 6 MOA to 10 MOA, such as about 8 MOA.

A first parameter of the first section 910 is controllable independently of a second parameter of the second section 930. A third parameter of the third section 950 is controllable independently of the first and second parameters. A fourth parameter of the fourth section 970 is controllable independently of the first, second, and third parameters. The parameters can respectively include, for example, an on/off setting, a brightness (e.g., a light intensity), and/or a color. Other parameters are contemplated.

The present disclosure contemplates that the ordered numerals for items described herein are for clarity purposes and the items can be labeled with other numerals depending on the number of items present. For example, the fifth ratio described above can be referred to as a "first ratio" or a "second ratio," and/o the sixth ratio described above can be referred to as a "second ratio" or a "third ratio" if used in addition to the fifth ratio. As another example, the seventh ratio, the eighth ratio, the ninth ratio, the tenth ratio, the eleventh ratio, the twelfth ratio, and/or the thirteenth ratio described above can be respectively referred to as "a ratio" or a "first ratio."

The reticle 900 involves an adjustable multi-reticle. For example, the first section 910 and the second section 930 involve an adjustable dot such that the dot of the first section 910 appears larger when the second section 930 is illuminated in addition to the first section 910. For example, the spacing 911 and the gap 931 appear omitted in the sight picture to the user. The spacing 911, the outer dimension OD1 of the first section 910, and the inner dimension ID1 of the second section 930—and the associated ratios for these aspects—facilitate the larger dot in a manner that is clear and crisp with reduced or eliminated distortion and blurriness of the larger dot, while facilitating reliable operation and ease of manufacturing. For example, interference between the illuminated second section 930 and the illuminated first section 910 is reduced or eliminated while substantially maintaining the appearance of the shape of a dot. As another example, the appearance of the shape of the dot is clear and crisp during fast target transitions. Additionally, the gap 931, the dimension D1—and the associated ratios for these aspects—facilitate the larger dot in the manner that is clear and crisp while facilitating ease of manufacturing and reliable operation of the illuminator 103. For example, the appearance of the shape of the dot is substantially maintained while reliably providing power to the sections of the illuminator 103 to reliably and independently turn the sections 910, 930, 950, 970 on and off.

The adjustable reticle 900 facilitates modularity in target acquisition and shooting. For example, the smaller dot (e.g., the first section 910 on with the second section 930 off) can be used for more precise shots at longer distances, and/or shots at smaller targets, whereas the larger dot (e.g., both the first section 910 and the second section 930 on) can be used for faster shots, shots at shorter distances, and/or shots at larger targets. As another example, the third section 950 (including the arcuate portion 951, the first side portion 952, and/or the second side portion 953) can be used for quick target acquisition, leveling of the reticle 900, and/or alignment of the user's eye(s) with a line of sight of the view panel 102. The first side portion 952 and/or the second side portion 953 can be used for speed shooting (e.g., in shooting sports such as the Steel Challenge) and anticipating trigger sear engagement. For example, as a user moves the reticle 900 toward a target the user can complete a trigger pull as an outer edge 956 of the second side portion 953 reaches an outer edge of the target, and the trigger sear can be engaged after the shot and as the reticle 900 moves across the target and toward a second target. As a further example, the first section 910 and/or the second section 930 can be used to sight farther targets and the fourth section 970 can be used to sight closer targets. The first section 910 and/or the second section 930 can be zeroed for a distance (e.g., about 75 meters) and the outer point 971 can be used for targets at a closer distance (e.g., in a range of 0 meters to about 10 meters). Other distances are contemplated. The present disclosure contemplates that the larger dot can be illuminated in another manner. For example, at least one illuminator section of the illuminator 103 (such as the first illuminator section 1001 described below) can be moved to enlarge the first section 910 to have the outer dimension OD2 shown for the second section 930. For example, the illuminator 103 can be moved closer to the view panel 102 to increase the size of the first section 910, and the illuminator 103 can be moved farther from the view panel 102 to decrease the size of the first section 910. The illuminator 103 can be moved closed and farther from an aperture to increase or decrease the size of the first section 910. The aperture can be between the illuminator 103 and the view panel 102. The illuminator 130 can be moved, for example, using an adjustment knob that can be similar to the first adjustment knob 106 and/or the second adjustment knob 107.

Figure 10:
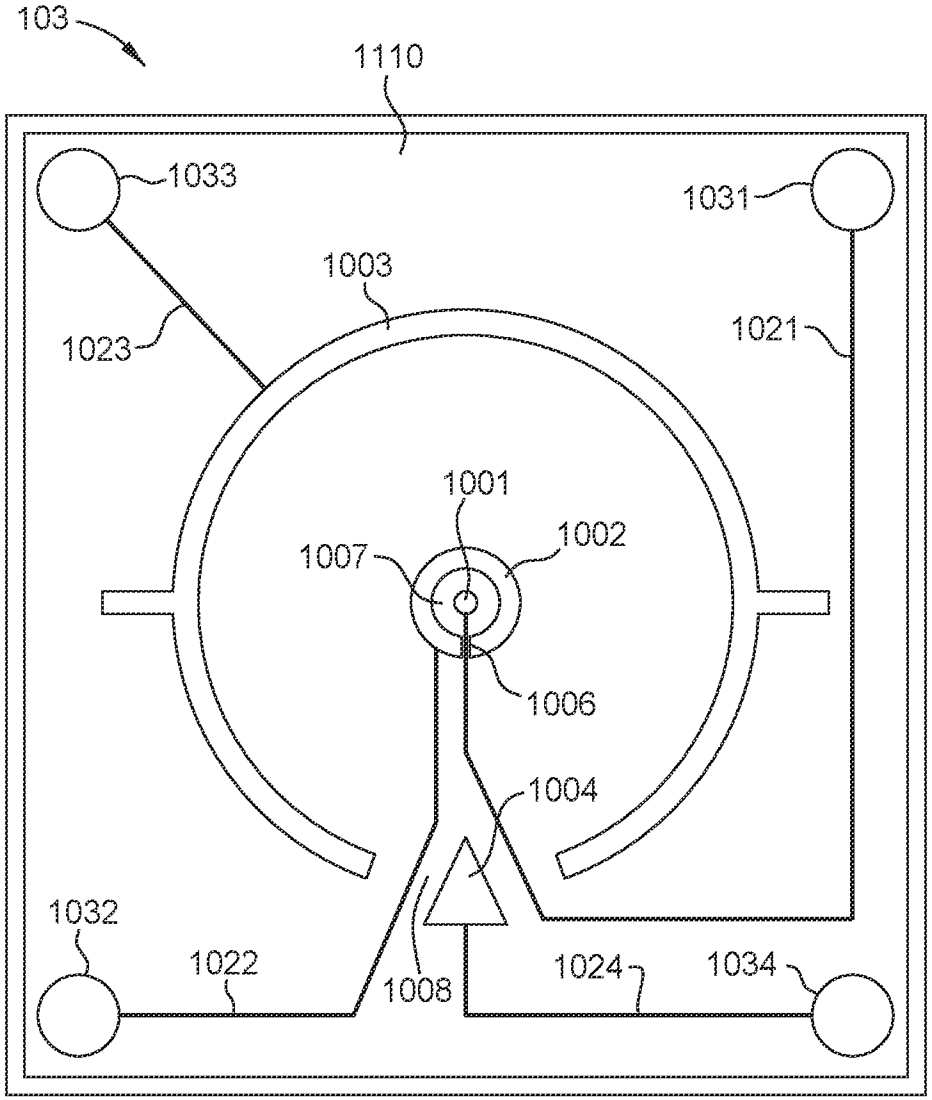
FIG. 10 is a schematic side view of the illuminator shown in FIG. 2, according to one or more embodiments.

FIG. 10 is a schematic side view of the illuminator 103 shown in FIG. 2, according to one or more embodiments.

The illuminator 103 is part of the controller 110. For example, the illuminator 103 can be disposed on a side of a PCB 1110 of the controller 110. The illuminator 103 includes a first illuminator section 1001 (e.g., a first light emitting diode (LED)) operable to illuminate the first section 910 of a reticle 900, a second illuminator section 1002 (e.g., a second LED) operable to independently illuminate the second section 930, a third illuminator section 1003 (e.g., a third LED) operable to independently illuminate the third section 950 of the reticle 900, and a fourth illuminator section 1004 (e.g., a fourth LED) operable to independently illuminate the fourth section 970 of the reticle 900. In one or more embodiments, the same brightness setting is applied to the respective illuminator sections 1001, 1002, 1003, and/or 1004 that are turned on. Other implementations are contemplated. The present disclosure contemplates that one LED or a plurality of LEDs can respectively be used for each of the illuminator sections 1001-1004. The first illuminator section 1001 is similar in shape to the first section 910 of the reticle 900 described above. The second illuminator section 1002 is similar in shape to the second section 930 of the reticle 900 described above. The third illuminator section 1003 is similar in shape to the third section 950 of the reticle 900 described above. The fourth illuminator section 1004 is similar in shape to the fourth section 970 of the reticle 900 described above.

The respective dimensions of the illuminator sections 1001-1004 of the illuminator 103 are equal to the respective dimensions described above for the sections 910, 920, 950, 970 divided by a factor. As such, the dimensions of the illuminator sections 1001-1004 equal to the dimensions of the sections 910, 920, 950, 970 scaled down by the factor. The respective ratios defining the dimensions of the illuminator sections 1001-1004 of the illuminator 103 are equal to the respective ratios described above for defining the dimensions of the sections 910, 920, 950, 970 of the reticle 900. For example, a spacing 1007 between the first illuminator section 1001 and the second illuminator section 1002 is the second ratio of the outer dimension of the first illuminator section 1001, the third ratio of the inner dimension of the third illuminator section 1003, and the thirteenth ratio of the second illuminator section 1002. As another example, a gap 1006 defined by the second illuminator section 1002 is the seventh ratio of the outer dimension relative to the first illuminator section 1001, the eighth ratio of the spacing 1007, the ninth ratio of the inner dimension of the second illuminator section 1002, and the tenth ratio of the inner dimension of the third illuminator section 1003. As a further example, the first section 1001 includes the first ratio and the fifth ratio described above, the second section 1002 includes the fourth ratio and the sixth ratio described above, and the radial distance of the fourth section 1004 includes the eleventh ratio and the twelfth ratio described above.

A first wire 1021 connects the first illuminator section 1001 to a first connector 1031 for power supply and power return to and from the first illuminator section 1001. A second wire 1022 connects the second illuminator section 1002 to a second connector 1032 for power supply and power return to and from the second illuminator section 1002. A third wire 1023 connects the third illuminator section 1003 to a third connector 1033 for power supply and power return to and from the third illuminator section 1003. A fourth wire 1024 connects the fourth illuminator section 1004 to a fourth connector 1034 for power supply and power return to and from the fourth illuminator section 1004. The first and second wires 1021, 1022 extend through a gap 1008 defined by the third illuminator section 1003. The first wire 1021 extends through the gap 1006 defined by the second illuminator section 1002.

Figure 11:
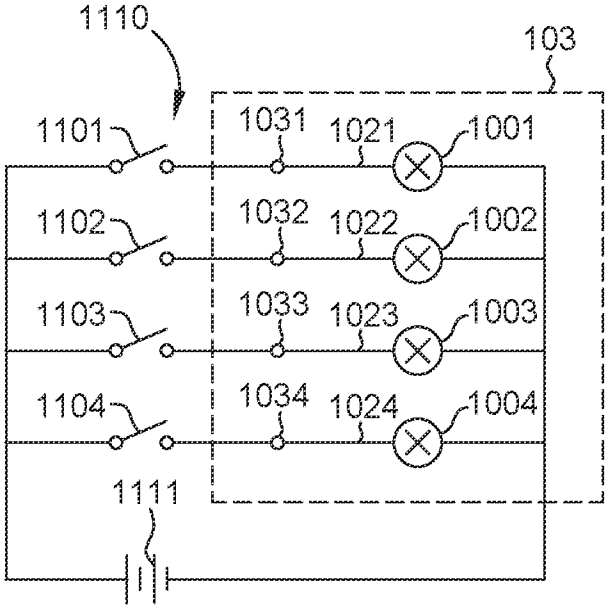
FIG. 11 is a schematic partial circuit diagram view of the illuminator and the PCB of the controller shown in FIG. 10, according to one or more embodiments.

FIG. 11 is a schematic partial circuit diagram view of the illuminator 103 and the PCB 1110 of the controller 110 shown in FIG. 10, according to one or more embodiments. The processor 113 of the controller 110 controls a plurality of switches 1101, 1102, 1103, 1104 (e.g., relays) to independently supply power respectively to the four illuminator sections 1001-1004 (e.g., the four LEDs). The switches 1101-1104 are respectively connected to the wires 1021-

1024 through the connectors 1031-1034. A power source 1111 is connected to the switches 1101-1104. The power source 1111 can include, for example, a battery and/or a solar cell.

FIGS. 12A-12E is a schematic process flow view of a method of illuminating the reticle 900 on the sight device 100 or 700, according to one or more embodiments. FIGS. 12A-12E show the sequence of the sections 910, 930, 950, 970 illuminated for the reticle 900.

Figures 12A, 12B, 12C, 12D, 12E:
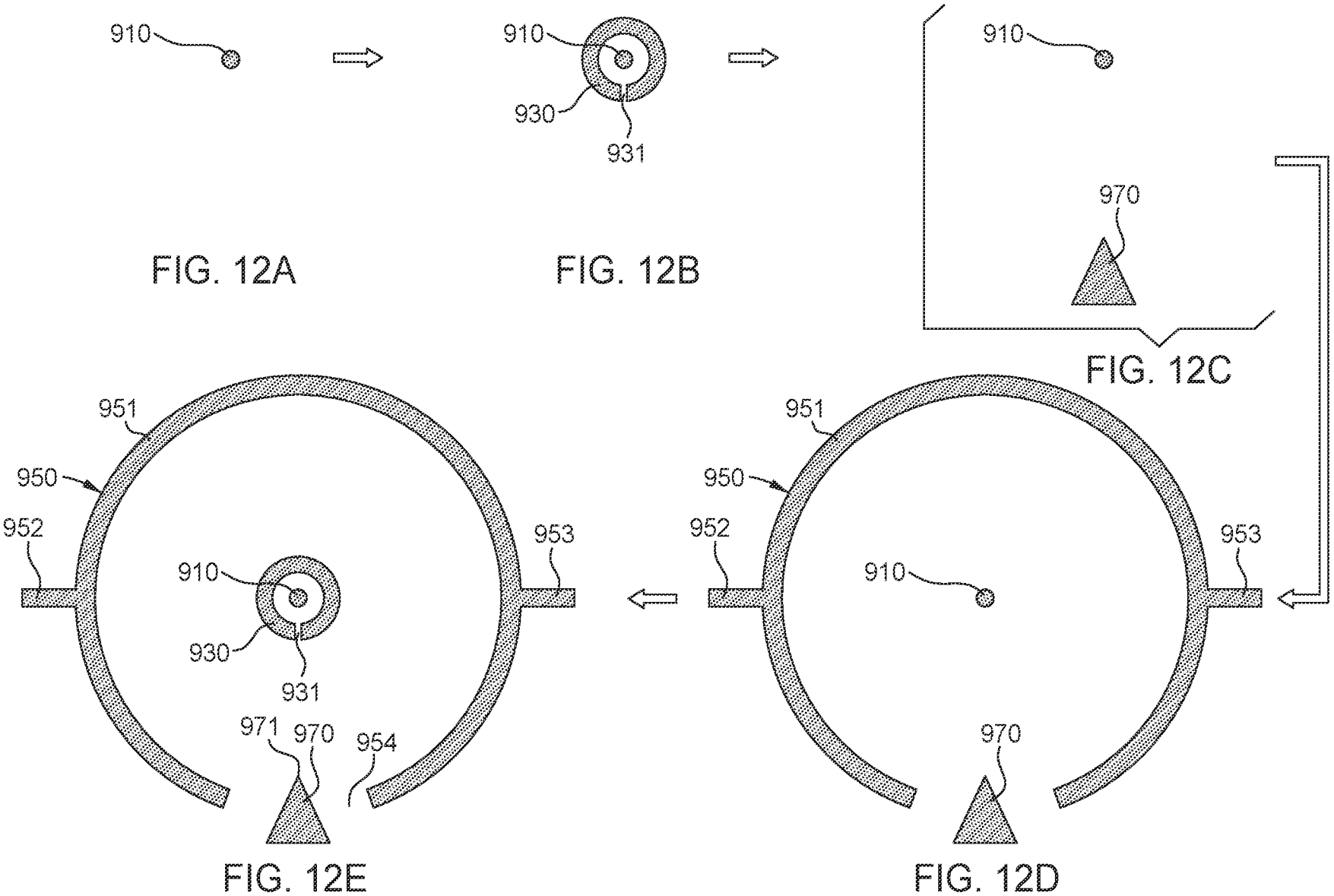
FIGS. 12A-12E is a schematic process flow view of a method of illuminating the reticle on the sight device, according to one or more embodiments.

At FIG. 12A, a first operation includes initiating an illumination of the first section 910 of the reticle 900. The first operation includes powering the first illuminator section 1001 to turn on the first section 910.

At FIG. 12B, a second operation includes initiating an illumination of the second section 930 of the reticle 900 radially outwardly of the first section 910 after the initiating of the illumination of the first section 910 (FIG. 12A). The illumination of the second section 930 initiated while the first section 910 is illuminated. The second operation includes powering the second illuminator section 1002 to turn on the second section 930.

At FIG. 12C, a third operation includes ending the illumination of the second section 930. The third operation includes ending power to the second illuminator section 1002 to turn off the second section 930. Also at FIG. 12C, a fourth operation includes initiating an illumination of the fourth section 970 (e.g., a point section) of the reticle 900 radially outwardly of the second section 930 after the ending of the illumination of the second section 930. The illumination of the fourth section 970 is initiated while the first section 910 is illuminated. The fourth operation includes powering the fourth illuminator section 1004 to turn on the fourth section 970. The third operation and fourth operation can be conducted simultaneously or sequentially with respect to each other.

At FIG. 12D, a fifth operation includes initiating an illumination of the third section 950 of the reticle 900 radially outwardly of the second section 930 after the initiating of the illumination of the fourth section 970 (FIG. 12C). The illumination of the third section 970 is initiated while the first section 910 and the fourth section 970 are illuminated. The fifth operation includes powering the third illuminator section 1003 to turn on the third section 950.

At FIG. 12E, a sixth operation includes re-initiating the illumination of the second section 930 of the reticle 900 after the initiating of the illumination of the third section 950 (FIG. 12D). The illumination of the second section 930 is re-initiated while the first section 910, the fourth section 970, and the third section 950 are illuminated. The sixth operation includes powering the second illuminator section 1002 to turn on the second section 930.

The method of FIGS. 12A-12E facilitate modularity in quickly cycling between a variety of reticle settings for a variety of shooting conditions (such as shooting speed, target size, and/or target distance) for competition shooting and other shooting applications. For example, the method can quickly cycle between reticle settings for shooting conditions that can arise in competition shooting applications, military shooting applications, law enforcement shooting applications, and/or recreational shooting applications.

The subject matter of the present application can be expressed in one or more of the following Examples.

Example 1 includes a reticle that includes:

a first section;

a second section disposed radially outwardly of the first section;

a third section disposed radially outwardly of the second section; and a fourth section at least partially aligned with the third section at a radial location.

Example 2 includes the reticle of Example 1, wherein the third section at least partially defines a gap, and the fourth section is disposed at least partially in the gap.

Example 3 includes the reticle of Example 1, wherein the fourth section includes an outer point disposed radially between the third section and the second section.

Example 4 includes the reticle of Example 3, wherein the outer point is an apex of the fourth section.

Example 5 includes the reticle of Example 3, wherein the outer point is disposed at a radial distance, the radial distance is a ratio of an inner dimension of the third section, and the ratio is less than 0.5 and equal to or greater than 0.4.

Example 6 includes the reticle of Example 5, wherein the inner dimension of the third section is an inner diameter.

Example 7 includes the reticle of Example 3, wherein the outer point is disposed at a radial distance, the radial distance is a ratio of an outer dimension of the second section, and the ratio is at least 2.0.

Example 8 includes the reticle of Example 7, wherein the outer dimension of the second section is an outer diameter.

Example 9 includes the reticle of Example 1, wherein the first section includes a dot, the second section includes a first arc, the third section includes a second arc, and the fourth section includes a triangle.

Example 10 includes a sight device operable to view the reticle of Example 1.

Benefits of the present disclosure include enhanced shooting accuracy; enhanced speed; adjustable reticles for sight modularity; sighting targets at a variety of distances and a variety of speeds (e.g., using a variety of shot split times, a variety of target transition speeds, and a variety of target acquisition speeds); and quick and easy aligning and/or leveling of reticles. Benefits of the present disclosure also include enhanced reticle clarity and sight clarity (such as reduced or eliminated distortion and blur for, e.g., an adjustable dot); and reduced or eliminated obstruction of targets. Such benefits can be further enhanced depending on user conditions, such as eye astigmatism.

Benefits of the present disclosure also include reduced or eliminated obstruction of view panels and/or illuminators using a cover while facilitating reliable coupling of the cover to the sight device, reduced sight footprints, and enhanced sight modularity.

It is contemplated that one or more aspects disclosed herein may be combined. As an example, one or more aspects, features, components, operations and/or properties of the sight device 100; the illuminator 103; the controller 110; the outer surfaces 125; the cover 300; the outer surfaces 325; the sight device 700; the outer surfaces 725; the reticle 900; the PCB 1110; and/or the method shown in FIGS. 12A-12E may be combined. Moreover, it is contemplated that one or more aspects disclosed herein may include some or all of the aforementioned benefits.

While the foregoing is directed to embodiments of the present disclosure, other and further embodiments of the disclosure may be devised without departing from the basic scope thereof, and the scope thereof is determined by the claims that follow.

What is claimed is:

1. A sight device, comprising:

an illuminator comprising:

a first illuminator section operable to illuminate a first section of a reticle, and a second illuminator section operable to illuminate a second section of the reticle radially outwardly of the first section, an outer dimension of the first section is a first ratio of an inner dimension of the second section, and the first ratio is less than 1:3.

2. The sight device of claim 1, wherein a first parameter of the first section is controllable independently of a second parameter of the second section.

3. The sight device of claim 1, wherein the first ratio is within a range of 0.29 to 0.31.

4. The sight device of claim 1, wherein a spacing is between the outer dimension of the first section and the inner dimension of the second section, the spacing is a second ratio of the outer dimension of the first section, and the second ratio is greater than 1.0.

5. The sight device of claim 4, wherein the second ratio is within a range of 1.10 to 1.2.

6. The sight device of claim 4, wherein the spacing surrounds the first section, and the second section partially surrounds the first section.

7. The sight device of claim 4, wherein the illuminator further comprises:

a third illuminator section operable to illuminate a third section of the reticle radially outwardly of the second section, wherein the spacing is a third ratio of an inner dimension of the third section, and the third ratio is 0.05 or less.

8. The sight device of claim 1, wherein the illuminator further comprises:

a third illuminator section operable to illuminate a third section of the reticle radially outwardly of the second section, wherein:

the outer dimension of the first section is a second ratio of an inner dimension of the third section, and the second ratio is 0.05 or less, and, the inner dimension of the second section is a third ratio of the inner dimension of the third section, and the third ratio less than 0.2.

9. A sight device, comprising:

an illuminator comprising:

a first illuminator section operable to illuminate a first section of a reticle, a second illuminator section operable to illuminate a second section of the reticle radially outwardly of the first section at a spacing from the first section, the second section defining a gap radially outwardly of the spacing, a dimension of the gap is less than an outer dimension of the first section, the dimension of the gap is a ratio of the outer dimension of the first section, and the ratio is less than 0.6.

10. The sight device of claim 9, wherein the ratio is greater than 0.4.

11. The sight device of claim 9, wherein the dimension of the gap is a second ratio of the spacing, and the second ratio is less than 1.3.

12. The sight device of claim 9, wherein the dimension of the gap is a second ratio of an inner dimension of the second section, and the second ratio is less than 0.5.

13. The sight device of claim 9, wherein the illuminator further comprises:

a third illuminator section operable to illuminate a third section of the reticle radially outwardly of the second section, wherein the dimension of the gap is a second ratio of an inner dimension of the third section, and the second ratio is less than 0.06.

14. The sight device of claim 9, further comprising a sight housing at least partially supporting the illuminator and a view panel, the sight housing comprising a panel section, and the panel section comprising a plurality of planar outer surfaces oriented to intersect each other and form a plurality of outer edges between adjacent outer surfaces.

15. The sight device of claim 14, further comprising a cover coupled to the sight housing, the cover comprising a cover housing at least partially supporting a second view panel, and the cover housing comprising:

a panel section;

a first extension extending relative to the panel section; and a second extension extending relative to the panel section, the second extension spaced from the first extension.

16. A non-transitory computer readable medium comprising instructions that when executed cause a plurality of operations to be conducted, the plurality of operations comprising:

initiating an illumination of a first section of a reticle;

initiating an illumination of a second section of the reticle radially outwardly of the first section after the initiating of the illumination of the first section, the illumination of the second section initiated while the first section is illuminated;

ending the illumination of the second section; and initiating an illumination of a point section of the reticle radially outwardly of the second section after the ending of the illumination of the second section, the point section comprising an outer point, and the illumination of the point section initiated while the first section is illuminated.

17. The non-transitory computer readable medium of claim 16, wherein the plurality of operations further comprise:

initiating an illumination of a third section of the reticle radially outwardly of the second section after the initiating of the illumination of the point section, the illumination of the third section initiated while the first section and the point section are illuminated, wherein the point section is at least partially aligned with the third section at a radial location.

18. The non-transitory computer readable medium of claim 17, wherein the plurality of operations further comprise:

re-initiating the illumination of the second section of the reticle after the initiating of the illumination of the third section, the illumination of the second section re-initiated while the first section, the point section, and the third section are illuminated.

19. The sight device of claim 1, further comprising:

a sight housing at least partially supporting the illuminator and a view panel, the sight housing comprising a panel section, and the panel section comprising a plurality of planar outer surfaces oriented to intersect each other and form a plurality of outer edges between adjacent outer surfaces; and a cover coupled to the sight housing, the cover comprising a cover housing at least partially supporting a second view panel, and the cover housing comprising:

a panel section;

a first extension extending relative to the panel section; and a second extension extending relative to the panel section, the second extension spaced from the first extension.

20. A sight device, comprising:

an illuminator comprising:

a first illuminator section operable to illuminate a first section of a reticle, a second illuminator section operable to illuminate a second section of the reticle radially outwardly of the first section at a spacing from the first section, the second section defining a gap radially outwardly of the spacing, a dimension of the gap is less than an outer dimension of the first section;

a sight housing at least partially supporting the illuminator and a view panel, the sight housing comprising a panel section, and the panel section comprising a plurality of planar outer surfaces oriented to intersect each other and form a plurality of outer edges between adjacent outer surfaces; and a cover coupled to the sight housing, the cover comprising a cover housing at least partially supporting a second view panel, and the cover housing comprising:

a panel section, a first extension extending relative to the panel section, and a second extension extending relative to the panel section, the second extension spaced from the first extension.

* * * * *